US005982095A

United States Patent [19]

Jin et al.

[11] Patent Number: 5,982,095

[45] **Date of Patent: *Nov. 9, 1999**

[54] PLASMA DISPLAYS HAVING ELECTRODES OF LOW-ELECTRON AFFINITY MATERIALS

[75] Inventors: Sungho Jin, Millington; Gregory Peter Kochanski, Dunellen; Wei Zhu, North Plainfield, all of N.J.

[73] Assignee: Lucent Technologies Inc., Murray Hill, N.J.

[ * ] Notice: This patent is subject to a terminal disclaimer.

[21] Appl. No.: 08/530,978

[22] Filed: Sep. 19, 1995

[51] Int. Cl.[6] ..... H01J 17/49

[52] U.S. Cl. ..... 313/582; 313/584; 313/311

[58] Field of Search ..... 313/153, 154, 313/156, 160, 161, 582, 584–586, 587, 309, 336, 351, 311–346 R

[56] References Cited

U.S. PATENT DOCUMENTS

| | | | |
|---|---|---|---|
| 5,473,396 | 12/1995 | Okajima et al. | 353/122 |
| 5,616,368 | 4/1997 | Jin et al. | 427/535 |
| 5,637,950 | 6/1997 | Jin et al. | 313/310 |
| 5,663,611 | 9/1997 | Seats et al. | 313/584 |
| 5,717,292 | 2/1998 | Jin et al. | 313/582 |

OTHER PUBLICATIONS

H.G. Slottow, "Plasma Displays", *IEEE Trans. on Electron Devices*, vol. ED–23, No. 7, pp. 760–772 (1976).

S. Mikoshiba, "Plasma Displays", *Society for Information Display*, Seminar No. F–2 (1993).

A. Sobel, "Gas–Discharge Displays: The State of the Art", *IEEE Trans. on Electron Devices*, vol. ED–24, No. 7, pp. 835–847, (1977).

G. Chodil, "Gas Discharge Displays for Flat–Panel", Proceeding of the S.I.D. vol. 17/1, pp. 14–22 (1976).

P. Pleshko, "AC Plasma Display Technology Overview", Proceeding of the S.I.D. vol. 20/3, pp. 127–130 (1979).

P. Pleshko, "AC Plasma Display Device Technology: An Overview", Proceedings of the S.I.D. vol. 21/2, pp. 93–99, (1980).

*Primary Examiner*—Jay M. Patidar

*Attorney, Agent, or Firm*—Glen E. Books; Bruce S. Schneider; John M. Harman

[57] ABSTRACT

Improved plasma displays utilize electrodes including low electron affinity (LEA) materials such as diamond. In dc displays the LEA materials are disposed on the cathode. In ac displays the LEA materials are disposed on the dielectric layers of both electrodes. The improved displays exhibit reduced operating voltage, higher resolution, and enhanced robustness.

13 Claims, 4 Drawing Sheets

PLASMA DISPLAYS HAVING ELECTRODES OF LOW-ELECTRON AFFINITY MATERIALS

FIELD OF THE INVENTION

This invention pertains to plasma displays having an improved electrode structure comprising a low electron affinity material such as diamond or aluminum nitride.

BACKGROUND OF THE INVENTION

Plasma displays utilize emissions from regions of low pressure gas plasma to provide visible display elements. A typical display cell comprises a pair of electrodes within a sealed cell containing a noble gas. When a sufficient voltage is applied between the electrodes, the gas ionizes, forms a plasma, and emits visible and ultraviolet light. Visible emissions from the plasma can be seen directly. Ultraviolet emissions can be used to excite visible light from phosphors. An addressable array of such display cells forms a plasma display panel. Typically display cells are fabricated in an array defined by two mating sets of orthogonal electrodes deposited on two respective glass substrates. The region between the substrates is filled with a noble gas, such as neon, and sealed.

Plasma displays have found widespread applications ranging in size from small numeric indicators to large graphics dismays. Typical applications are described in H. G. Slottow, *IEEE Trans. Electron Devices*, Vol. ED-23, No. 7, p. 760 et seq (1976) and S. Mikoshiba, *Society for Information Display*, Seminar No. F-2 (1993) which are incorporated herein by reference. Plasma displays are strong contenders for future workstation displays and HDTV displays.

The commercial success of plasma displays is due to many desirable properties. For example, a plasma has very strong nonlinear current-voltage characteristic which is ideally suited for multiplexing or matrix addressing. This nonlinearity also provides internal memory and logic capabilities which can be used to reduce the number of external circuit drivers. The ultraviolet radiation from a plasma can be used to excite phosphors, thereby permitting fabrication of full color displays. Other favorable attributes of plasma displays include long lifetime (~10,000 hrs for dc displays and >50,000 hrs for ac displays) with no catastrophic failure mechanism. They provide high resolution, good contrast ratio, a wide viewing angle (comparable to a CRT), and gray scale capability (8-bit, 256 levels). The displays are rugged, self-supporting structures which can be made in large areas (a display as large as 1.5 m diagonal with 2,048×2,048 pixels has been reported), and they are tolerant to harsh environment and wide temperature variations. The principal drawbacks of plasma displays are their high driver voltage (150–200 V), relatively low luminance (~100 cd/m$^2$ compared to 700 cd/m$^2$ for a CRT) and low luminous efficiency (0.2 lm/W compared to 4 lm/W for a CRT).

Plasma displays are usually classified as dc or ac. In a dc display, the electrodes are in direct contact with the plasma. The current is limited by resistance. In an ac display the electrodes are typically separated from the plasma by a dielectric, and the current is limited by capacitance.

DC displays ultimately fail because the cathode material is gradually sputtered or eroded away under the bombardment of positively charged energetic ions from the plasma. Erosion or sputtering of these cathode materials limits the typical lifetime of a dc plasma display at ~10,000 hours. The sputtering also leads to the deposit of cathode material on the inner surface of the enclosing glass envelope, reducing the transmission of light.

Addition of small amounts of mercury reduces the sputtering problem but does not solve it. Although the addition of mercury in the gas reduces the effect of sputtering by several orders of magnitude, mercury particles tend to condense at the coldest spot. As a result, active regions where sputtering is severe have less mercury. Mercury is also chemically reactive with metals such as Ba and Ag which are used as electrode or electric lead materials. In addition, the strong visible emission from mercury degrades the color purity.

AC displays using conventional materials are subject to problems of contamination. In a typical ac plasma display the conductive electrode is covered by a dielectric layer which is, in turn, overcoated with MgO. The MgO overcoating has a high secondary electron emission coefficient which reduces the breakdown voltage for the gas. In addition, MgO is resistant to sputtering and thus gives the device a very long lifetime. The problem is that MgO is susceptible to contamination in the manufacturing process. Once contaminated, it is virtually impossible to clean.

The high operating voltage (150–200 V) in conventional plasma displays is disadvantageous. The use of relatively high operating voltages and associated problems in dielectric breakdown make it necessary to use tall dielectric barrier ribs between the cathode and the anode. Since much of the energy loss in the plasma displays is due to the collision of the plasma with the barrier ribs, high aspect ratio display cells with large surface to volume ratios are not desirable. In addition, higher pixel-density displays with smaller cell sizes are difficult to obtain if the barrier rib is to stay tall.

If the operating voltage can be lowered, the height of the rib can be reduced and hence smaller cell sizes can be implemented. Shorter ribs would increase the solid angle subtended by the front transparent electrode and reduce the number of photons absorbed by the barrier rib. Thus for a given input power, more photons would exit the display.

Accordingly, there is a need to develop new electrode materials for both dc and ac plasma displays which will provide low operating voltage, mechanical robustness, chemical stability and tolerance to harsh environment.

SUMMARY OF THE INVENTION

Improved plasma displays utilize electrodes comprising low electron affinity (LEA) materials such as diamond. In dc displays the LEA materials are primarily disposed on the cathode. In ac displays the LEA materials are primarily disposed on the dielectric layers of both electrodes. The improved displays exhibit reduced operating voltage, higher resolution, and enhanced robustness.

BRIEF DESCRIPTION OF THE DRAWINGS

The nature, advantages and various additional features of the invention will appear more fully upon consideration of the illustrative embodiments now to be described in detail in connection with the accompanying drawings. In the drawings.

It is to be understood that the drawings are for purposes of illustrating the concepts of invention and are not to scale.

DETAILED DESCRIPTION

This description is divided into three parts. Part I describes a dc plasma display cell having an improved cathode structure. Part II describes the fabrication of dc plasma displays using the improved cell of Part I, and Part III describes an ac plasma display having improved electrodes.

I. Improved DC Plasma Display Cell

Figure 1:
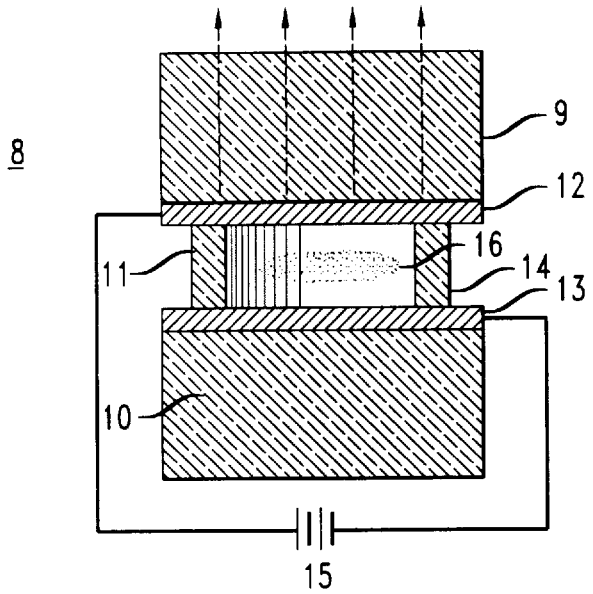
FIG. 1 (PRIOR ART)
FIG. 1 is a cross section of a typical conventional dc plasma display cell.

Referring to the drawings, FIG. 1 is a cross sectional view of a conventional cell 8 for a dc plasma display. The cell 8 comprises a pair of glass plates 9 and 10 separated by barrier ribs 11. One plate 9 includes a transparent anode 12. The other plate 10 includes a cathode 13. The plates 9, 10 are typically soda lime glass. The anode 12 is typically a metal mesh or an indium-tin-oxide (ITO) coating. The cathode 13 is either metal such as Ni, W and stainless steel or a conductive oxide. A noble gas 14 such as neon, argon or xenon (or mixtures thereof) is filled in the space between the electrode. The barrier ribs 11 are dielectric, and typically they separate plates 9, 10 by about 200 $\mu$m. In operation, a voltage from a power supply 15 is applied across the electrodes. When the applied voltage is sufficiently high, a plasma 16 forms and emits visible and ultraviolet light.

The difficulty with this conventional dc cell can now be readily seen. Since the cathode 13 is immersed in the plasma 16, it is subject to bombardment by energetic ions. The sputtering effect produced by this bombardment severely limits the lifetime of the cathode 13.

Figure 2:
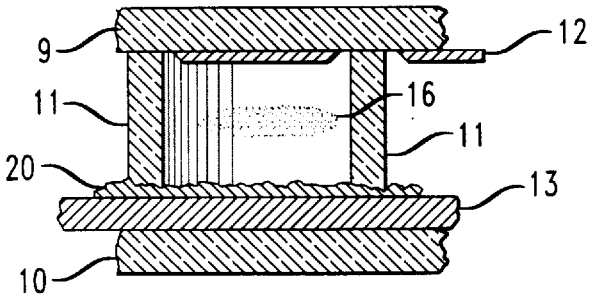
FIG. 2 shows a dc plasma display cell having cathode comprising a low electron affinity material.

FIG. 2 schematically illustrates an improved display cell in accordance with the invention. The cell of FIG. 2 is similar to that of FIG. 1 except that the cathode comprises an additional layer of low electron affinity material (LEA material 20) such as diamond. The layer 20 is preferably disposed on conductor 13. The term low electron affinity material refers to materials having electron affinities (work functions) below about 3 electron volts (eV) and preferably below about 2 eV and specifically includes materials having negative electron affinities (NEA materials). The presence of the LEA material 20 will allow the plasma 16 to be generated at lower voltages because electron emission from the LEA material under electrical field or upon collision with ions, metastables and photons is much easier than with conventional materials. This facilitated emission greatly reduces the power consumption, simplifies the driver circuitry, and permits higher resolution.

Diamond, and particularly diamond treated with hydrogen plasma, is the preferred LEA material. Diamond can actually be made with a negative electron affinity. Moreover, diamond is one of the hardest materials known and is highly resistant to sputtering. The inventors have previously discovered that defect-rich diamond made by chemical vapor deposition (CVD) is a low voltage field emitter. See, Jin et al, U.S. Pat. No. 5,637,950 filed Oct. 31, 1995 and entitled "Field Emission Devices Employing Enhanced Diamond Field Emitters" which is incorporated herein by reference. The defect-rich diamond referred to herein is characterized in Raman spectroscopy by a diamond peak at 1332 $cm^{-1}$ broadened by a full width at half maximum in the range 5–15 $cm^{-1}$ and preferably 7–11 $cm^{-1}$. Further, nanometer diamond powders made by high temperature, high pressure processes (explosive or static) have superior electron emission properties when they are pretreated in a hydrogen plasma at temperatures of 500–800° C. See, Jin et al. U.S. Pat. No. 5,616,368 filed Jan. 31, 1995, and entitled "Field Emission Devices Employing Activated Diamond Particle Emitters And Methods For Making Same", which is incorporated herein by reference. Nanometer diamonds as used herein refers to diamond particles having maximum dimensions in the range 5 nm to 1000 nm and preferably 10 nm to 300 nm. The nanometer diamonds are desirably uniform in size. Preferably 90% by volume have maximum dimensions between ⅓ the average and 3 times the average. Photoemission measurements indicate that the electron affinity is negative. Diamond-like carbon (DLC), aluminum nitride (AlN) and aluminum-gallium-nitride (AlGaN) also possess low or negative electron affinity (below ~3 eV) and are good LEA materials for improving the cathode in a dc plasma.

Figure 3:
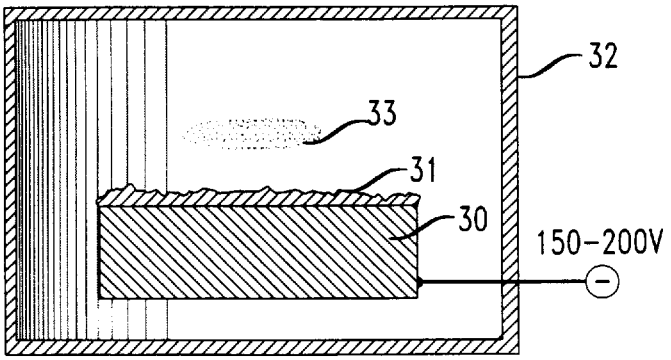
FIG. 3 is an experimental set-up for demonstrating the effect of low electron affinity materials on the generation of a plasma.

FIG. 3 shows an experimental set up for demonstrating that a cathode comprising a low electron affinity material can significantly reduce the plasma turn-on voltage as compared with a metallic cathode. A Mo cathode 30 provided with a diamond coating 31 was disposed within a stainless steel vacuum chamber 32, and a plasma 33 was struck near the cathode. When pure Mo was used as the cathode, a voltage up to −300 V applied onto the cathode produced no visible plasma from a 10 torr hydrogen gas. However, when the Mo surface was coated with a thin film of diamond 31 as shown in FIG. 3, the breakdown voltage of the hydrogen gas occurred at ~150–200 V producing a strong visible glow near the cathode surface. It is believed that because of the low electron affinity associated with diamond, a number of important reactions occurring at the cathode surface such as collisions from ions, metastable atoms or photons stimulate the ejection of electrons from the cathode surface. The ejected electrons initiate the volume reactions and lower the threshold voltage for the turn-on of a plasma.

The preferred thickness of the LEA material on the cathode is in the range of 0.005–10 $\mu$m, and more preferably 0.02–1 $\mu$m. The desired shape of the cathode material is preferably a thin film or layer. Protrusion of sharp crystallographic facets or points is desired for field concentration. Such films are typically prepared by chemical vapor deposition (CVD) growth on a conductive substrate. Physical or electrochemical deposition methods are not precluded. It is important that the deposited films are made electrically conductive, either by inducing growth defects or by doping. Diamonds can be conductively doped by incorporation of B, N, C, P during CVD growth or by ion implantation of these dopants after growth, optionally followed by annealing.

As an alternative to growing LEA films, very fine particles of LEA material can be dispensed on a conductive substrate surface as a uniform-thickness layer and then be bonded onto the substrate. Mechanical contact alone is to be avoided because the high contact resistance between the LEA particles and the substrate makes the electron transport difficult.

The preferred LEA particles are diamonds with particle size in the range of 0.002–1 $\mu$m, and preferably 0.005–0.5 $\mu$m. Particularly desirable are nanometer-sized diamond particles sold by E. I. DuPont under the product name Mypolex or similar size diamond particles sold by General Electric. These nanometer diamonds, when processed as described herein, exhibit very low electron-emitting threshold voltage for improved plasma displays as described herein. The exact reason for this unusual emission behavior—which is not seen in typical, insulating diamond particles (e.g., larger than ~1 μm size)—is not clearly understood. It is, however, believed due to specific defects present in the nanometer-structured diamond particles.

Another advantage in using fine particle diamond is the ease of deposition by spray coating or electrophoretic deposition. A hydrogen plasma heat treatment of the spray-coated nanometer diamond particles on silicon substrates at 200–1000° C. for 1–1000 min. creates chemical bonding and electrical contact at the particle-substrate interface, and at the same time, creates a clean, hydrogen-terminated, NEA surface on the diamond suitable for low-voltage plasma displays.

The desired cathode structure contains, on at least 60% and preferably at least 90% of its surface, one or more low electron affinity electron emitter materials. The preferred materials include, but are not restricted to, electrically-conductive diamond, AlN or AlGaN. The desired plasma turn-on voltage in the inventive displays is at most 150 volts, preferably below 80V, more preferably below 50V.

II. Fabrication of Plasma Displays

The present invention permits fabrication of higher-density, higher-resolution plasma displays because of the lowered plasma turn-on voltages. Plasma displays using low electron affinity cathodes can have at least 30% higher and preferably at least 100% higher cell density than conventional plasma displays.

Figure 4:
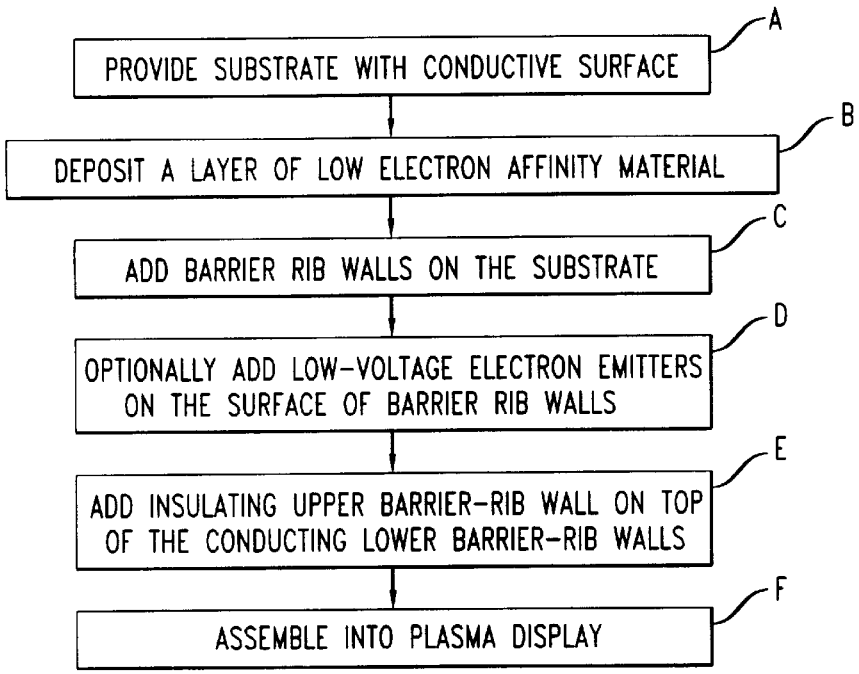
FIG. 4 is a block diagram of the steps involved in making improved dc plasma display.

An exemplary procedure for constructing a plasma display is illustrated in the flow diagram of FIG. 4. A plasma display is essentially an array of plasma cells of the type shown in FIG. 2. The first step (Block A in FIG. 4) is to provide substrate having a conductive surface suitably sized, surface-finished, and patterned (e.g. into a parallel stripes of conductor or conductor-coated surface) for use as a cathode. The substrate is preferably conductive coated glass. The preferred conductor materials include Mo, W, Hf, Zr, Ti, V, Si. It is generally preferable to choose carbide-forming metals for deposition of diamond LEA materials and nitride-forming metals for deposition of AlN or AlGaN. The conductors are typically patterned in thin or thick film stripes. The thickness of the conductor or conductive coating material is typically in the range of 0.1–100 μm, preferably 0.2–10 μm.

The second step (Block B in FIG. 4) is to deposit the LEA material on the surface of the cathode conductors. The material can be deposited by CVD, plasma jet deposition, or the hot filament process. Diamond films are advantageously deposited using microwave plasma enhanced CVD. An exemplary gas mixture is 1–10 volume % methane ($CH_4$) and $H_2$ gas, at a temperature of 400–1000° C. AlN or AlGaN films are preferably deposited by CVD processing using trimethyl aluminum or trimethyl gallium in ammonia at 500–1100° C. The steps A and B in FIG. 4 can be reversed if desired.

Figure 5:
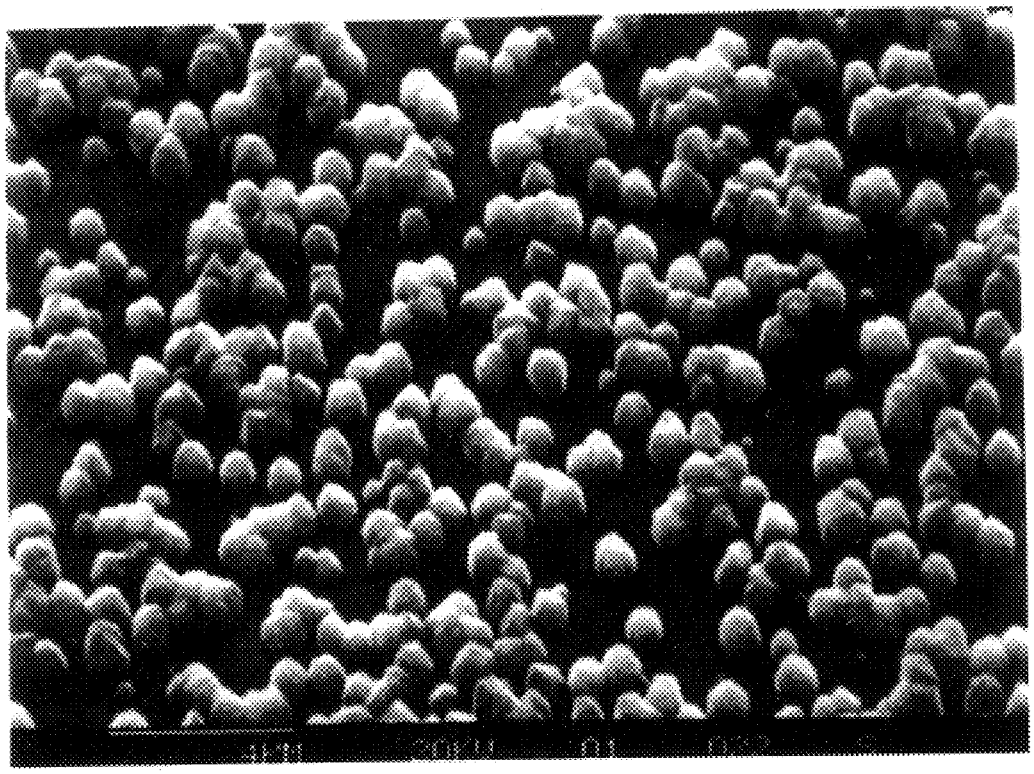
FIG. 5 is a scanning electron micrograph of diamond islands useful as low electron affinity materials.

The in-situ CVD-deposited LEA material typically possesses good chemical and electrical bonding to the substrate. The material can be deposited either as a continuous film or as islands completely separated from each other. The island geometry for the cathode LEA material is particularly beneficial not only because of the tendency of forming sharp crystallographic facets and corners pointing toward the anode for concentration of electric field (for easier electron emission). The island geometry has the additional advantage of the short paths of electron transport from the conductor substrate. The desired size of the CVD deposited islands is typically in the range of 0.05–10 μm, preferably 0.05–2 μm. An exemplary microstructure of a desirable diamond island geometry is shown in FIG. 5. The flat-bottomed, sharp-cornered diamond islands were deposited on Si by microwave CVD deposition at ~900° C. using a mixture of methane gas (2%) in hydrogen. The flat bottom configuration provides good electrical contact.

It is important to make the deposited LEA materials electrically conductive or semi-conductive for their efficient use in the plasma panel displays. This can be accomplished by growing the material with reduced energy band gap (e.g., by introducing lattice defects in diamond or doping to conductivity). Yet further in the alternative, an insulating LEA material can be surface coated with defect-rich LEA material or doped LEA material to enhance surface conductivity.

Instead of the continuous film or island LEA material configurations deposited by CVD processing, LEA particles can be prepared and adhered onto the conductive cathode surface. They can be pre-coated with defect-rich or doped LEA material, or they can be modified after deposition by ion implantation or by deposition of a surface layer of defect-rich or doped LEA material. The LEA particles should have good electrical contact with the conductive substrate underneath. Loose particles will not work efficiently as electron emitters because of high electrical contact resistance at the interface.

The loose LEA particles, e.g., diamond or AlN particles, once deposited on the conductive substrate surface, should be bonded onto the conductor in order to efficiently function as electron emitters. A preferred method to achieve this bonding is hydrogen plasma heat treatment. For example, nanometer diamond particles (0.01–0.05 μm sized, dispersed in a liquid medium) are spray coated on a Si surface and then are processed in hydrogen plasma at 200–1000° C. for 1–1000 min. Alternatively, the LEA particles may be embedded or compressed onto the conductor by mechanical pressing followed by heat treatment to create chemical bonding. The heat treatment can optionally be followed by hydrogen plasma processing or by surface deposition/growth of defect-rich or doped material.

It is preferred that the coating of LEA material be substantially pinhole-free. Exposed metal surface area (e.g., the conductor stripes underneath) may be sputtered away during the display operation and may undesirably be deposited on the LEA coating. At least 60% and preferably 90% of the conductor surface should be covered with the low-voltage electron emitter. Preferably any exposed metal areas are recessed well below the average surface in order to reduce sputtering and to confine the deposited material. In the case of plasma displays comprising nanometer diamond particles, a thickness equivalent to about 1–100 particle layers are generally desired, about 1–20 layers are preferred, and 2–10 layers are even more preferred.

The next step shown in Block C of FIG. 4 is to add barrier ribs (cavity walls) on selected locations on the surface of the cathode. The barrier ribs between adjacent cells are used to confine the plasma and ultraviolet photons to a single pixel, so that the overall display will exhibit good color, purity and contrast. The barrier ribs can be made with insulators such as glasses or ceramics. They can have a plate geometry with square, rectangular or round holes, or they can be long parallel strips. They typically have a wall thickness of about 5–200 μm with an aspect ratio of about 0.5–3. Preferably they have a 5–25 μm wall thickness with an aspect ratio of 1–2. The walls can be made by various well-known ceramic processing methods such as screen printing, spray coating, or dispenser writing of a powder-containing slurry followed by sintering/melting. Alternatively, the walls can be prepared by subtractive means such as lithographic etching, machining, laser ablation, or sand blasting of a flat blank ceramic layer.

Figure 6:
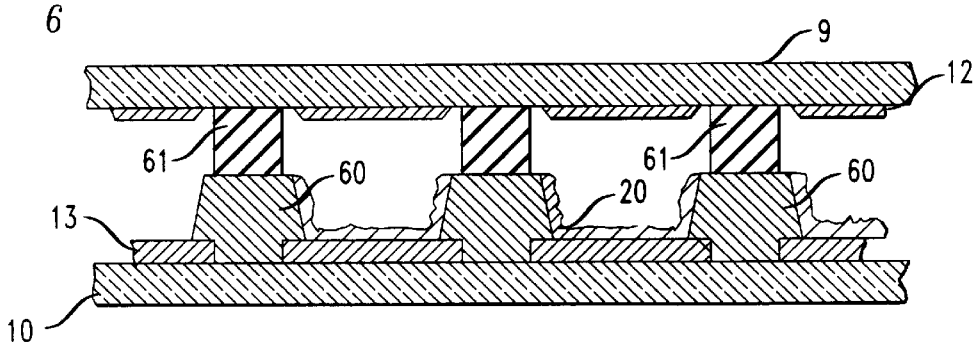
FIG. 6 is a schematic illustration of a first embodiment of a dc plasma display made by the process of FIG. 4.

A novel feature is the creation of an electron emitting or electron-multiplying surface on the barrier rib walls. This step essentially extends the cathode area by making a cup-shape (or U-shape) cathode surface as compared to the flat, horizontal cathode surface in prior art plasma displays, and it minimizes photon trapping and associated energy loss. Such a wall structure, can be a single unit or a two-part structure. FIG. 6 illustrates a two-part wall comprising a conductive barrier wall 60 at the bottom side and an electrically insulating barrier wall 61 at the upper side.

One exemplary processing sequence for constructing the display of FIG. 6 is as follows. On the substrate 10 (rear glass plate coated with conductive layer stripes 13), a lower ceramic barrier wall 60 is first added, e.g., by screen printing. If the lower barrier rib wall 60 is made of electrically insulating material such as glass, a thin conductive surface layer of conductive metal, oxide, or carbide (not shown) can be added by physical deposition (such as sputtering, or evaporation), by chemical deposition (such as CVD, electroplating, or electroless plating), or by mechanical deposition (such as spray coating of a powder-containing slurry followed by sintering or melting). Inclined-angle deposition is desirably utilized to access the vertical walls and corners in each cell.

Figure 7:
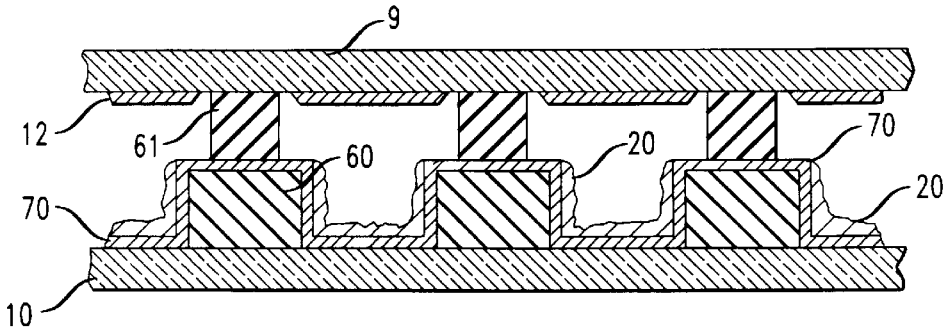
FIG. 7 is a schematic diagram of a second embodiment of a dc plasma display made by the process of FIG. 4.

If such a conductive layer is to be added to the barrier-rib wall, a particularly preferred method calls for combining this step with the previously mentioned step of providing conductive stripes on the substrate. In the resulting structure shown in FIG. 7, both the horizontal substrate surface and the near-vertical barrier wall surfaces can be coated with a conductive layer 70 at the same time.

Figure 8:
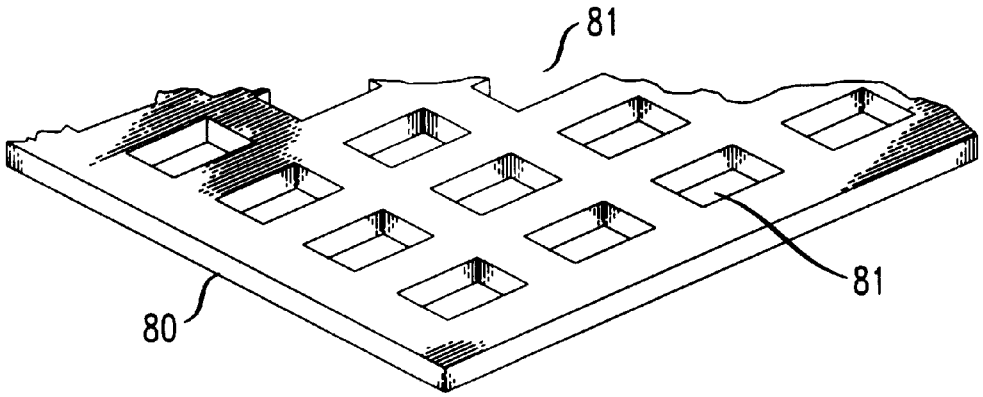
FIG. 8 schematically illustrates a pre-made barrier rib structure useful in the process of FIG. 4.

In another variation of the FIG. 6 structure, the conductive lower barrier rib wall can be pre-made as shown in FIG. 8. The pre-made structure is in the form of a screen 80 containing a plurality of through-holes 81 (round, square, hexagonal or other shaped holes). The pre-made structure dropped onto the substrate with conductive stripes. This process has a significant advantage in terms of rapid automated assembly of the plasma display device because it dispenses with the time-consuming steps of screen printing ceramic paste, drying, and curing on individual display. A conductive screen 80, with hole openings typically of about 5–200 μm size, can be prepared from thin sheet of metal, such as Ni, Mo, Ag, W, or their alloys, or from conductive ceramic materials. Advantageously, a conductive adhesive or solder material (not shown) is applied to the bottom surface of the drop-in screen for mechanical attachment and improved electrical conduction between the horizontal electrode and the vertical wall.

The next step shown in block D of FIG. 4 is to optionally add a LEA material on the surface of the barrier ribs. The conductive lower barrier rib material (or the surface conductive layer coating in the case of insulating wall material) is chosen so as to provide good adhesion and electrical connection to the LEA layer. Various materials mentioned earlier can be used. The structure and the deposition procedure for the LEA materials on the near-vertical barrier ribs are similar to those described earlier for the step B. The LEA materials can be added only on the lower portions 60 of the barrier ribs, or they can be added on both the lower and upper portions (60, 61).

The next step in FIG. 4 (step E) is to add electrically-insulating, upper barrier ribs (as shown schematically in FIG. 6) directly on top of the conducting lower barrier ribs. Either ceramic (such as glass) or polymer (such as polyimide or pyrolized polymer) material can be used. The upper barrier ribs can be added by a number of different processing techniques, e.g., by screen printing or spray coating of ceramic-particle-containing precursor slurry (or uncured polymer precursor liquid with suitable viscosity) followed by curing. One particularly convenient method utilizes the fact that the lower barrier ribs are protruding. The substrate with the lower barrier rib structure in place can be made to contact a lightly compliant pad containing or coated with the insulating precursor liquid or slurry (like a rubber stamp touching an ink pad wet with ink). The precursor liquid or the slurry is to be converted later into upper barrier ribs. The ink-pad-like device can be either a flat surface or a roller surface coated with the insulating precursor liquid or ceramic slurry. The desirable thickness of the insulating upper barrier rib material depends on the operating voltage for plasma turn-on. Typical thickness is in the range of 2–100 μm, and preferably in the range of 5–50 μm.

An alternative process is to use a pre-made screen of insulating material such as polymer or ceramic thin sheets, properly patterned to have registered holes to match those for the lower barrier-ribs.

The final step in FIG. 4 (step F) is to complete the plasma display device in the usual fashion by assembling the various other components. This involves adding anode, phosphor, mechanical support frames, a vacuum sealing structure, and various conventional electronic components.

In the case of diamond-coated cathodes, hydrogen plasma heat treatment at 200–1000° C. is advantageous for ensuring low-voltage electron emission (and hence low turn-on voltage in plasma displays), for example, at a field as low as 15 V/μm or preferably below 10 V/μm. The exact reason why hydrogen plasma treatment enhances electron emission is not clearly understood but it is believed to be the hydrogen termination of carbon bonds at the surface.

Another aspect of the present invention involves an optional use of hydrogen gas intentionally mixed in the plasma to maintain the hydrogen termination on the diamond surface and to minimize graphitization. The amount of hydrogen gas is at least one percent by volume and preferably at least five percent. In addition to or instead of hydrogen gas, hydrogen-storage materials that absorb or release hydrogen gas depending on temperature and partial pressure condition, can be added in the plasma display structure, either as a separate component or as a part of an existing component such as the barrier rib material or the electrodes. Hydrogen storage materials may be chosen from Pd, $LaNi_5$, Zr—Ni or Fe—Ti based intermetallic compounds, or zeolites. The presence of such hydrogen storage material maintains a relatively constant hydrogen partial pressure throughout the lifetime of the plasma panel display and hence improves its durability.

For nitrogen-containing LEA materials it is advantageous to include $N_2$ in the gas mixture. 1 to 5 volume percent is preferred.

III Improved AC Displays

AC plasma displays are differentiated from dc plasma displays in that both electrodes in an ac display are dielectric layers which form the cell's capacitance. The dielectric layer is, in turn, overcoated by a layer of MgO which is resistant to sputtering and has a high and stable secondary electron emission coefficient. But, as noted, MgO is very susceptible to contamination. In addition, deposition of MgO by sputtering is a lengthy process.

Figure 9:
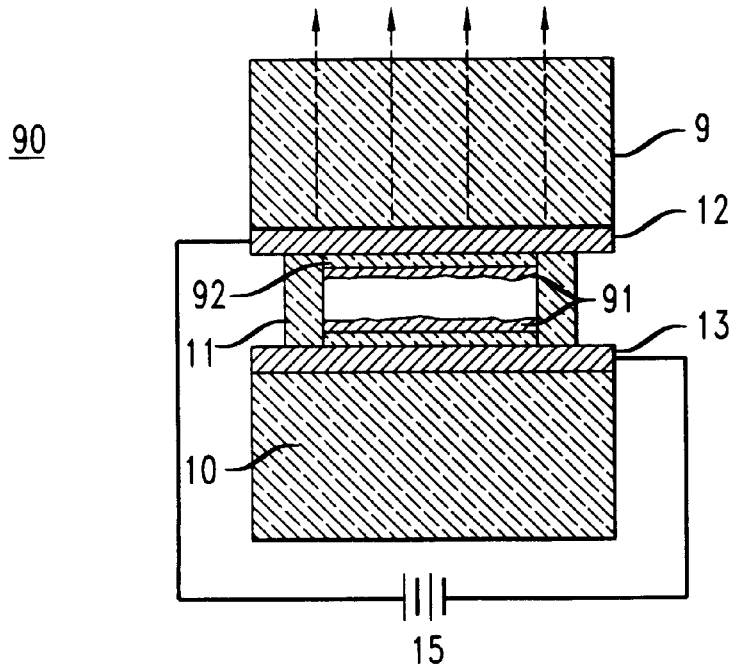
FIG. 9 is a schematic cross section of an ac plasma display using electrodes comprising low electron affinity material.

FIG. 9 shows an improved ac display cell 90 wherein a layer of LEA material 91 is substituted for MgO (or supplements MgO) on the dielectric layers 92, 93. Diamond has been found to be an ideal LEA material to replace or supplement MgO because diamond has a lower sputtering rate and a high secondary electron emission coefficient (as high as 50). More importantly, a hydrogen-terminated diamond surface is highly stable up to a temperature of at least 700° C. and is chemically inert. For electrodes 9, 10 in the ac plasma display, conventional CVD diamond (insulating diamond) without special defect engineering or doping can be used. The requirement for electrical resistivity of diamond in the ac plasma displays can be in a relatively wide range, e.g., $10^1$–$10^{12}$ ohm-cm. Higher resistivity is generally preferred, as this could provide self-limiting electron emission on local diamond regions and thus homogenize the emission. CVD diamond, either continuous film or islands, can be deposited directly on glass or ceramic dielectric layers. Alternatively, particulates such as nonconductive diamond particles can be attached on to the glass or ceramic surface and bonded by heat treatment. Again, optionally some hydrogen addition to the noble plasma gas will be beneficial for the continuous activation of the diamond particles.

The invention claimed is:

1. In a plasma display comprising at least one plasma display cell, said cell comprising a pair of electrodes and walls separating said electrodes and enclosing a volume containing gas, comprising noble gas, the improvement wherein at least one of said electrodes comprises a low electron affinity material having an electron affinity less than 3 electron volts comprising a material selected from the group consisting of diamond, aluminum nitride, and aluminum gallium nitride.

2. The improved plasma display of claim 1 wherein said low electron affinity material comprises defect-rich diamond.

3. The improved plasma display of claim 1 wherein said low electron affinity material comprises diamond particles.

4. The improved plasma display of claim 1 wherein said low electron affinity material is in the form of a layer having a thickness in the range 0.005–100 $\mu$m.

5. The improved plasma display of claim 1 wherein said low electron affinity material covers at least 60% of said electrode.

6. The improved plasma display of claim 1 wherein said plasma display cell has a turn-on voltage of less than 80 volts.

7. The improved plasma display of claim 1 wherein said walls comprise a low electron affinity material having an electron affinity less than 3 electron volts.

8. The improved plasma display of claim 1 wherein both electrodes of said pair comprise a low electron affinity material having an electron affinity less than 3 electron volts.

9. The improved plasma display of claim 1 wherein said low electron affinity material comprises diamond and said gas additionally comprises hydrogen.

10. The improved plasma display of claim 1 wherein said low electron affinity material comprises aluminum nitride or aluminum gallium nitride and said gas additionally comprises nitrogen.

11. The improved plasma display of claim 1 wherein said low electron affinity material comprises hydrogen-plasma treated diamond particles.

12. The improved plasma display of claim 1 wherein said plasma display cell further comprises hydrogen-storage material for releasing hydrogen into said gas.

13. The improved plasma display of claim 1 wherein one of said electrodes is a cathode having a u-shaped surface with ends projecting toward the other of said electrodes.

* * * * *